United States Patent [19]

Arola et al.

[11] Patent Number: 4,630,658

[45] Date of Patent: Dec. 23, 1986

[54] COUNTER ROTATING DOUBLE DISC CHUNKER

[75] Inventors: Rodger A. Arola, Hancock, Mich.; Hans-Olof Säll, Hedemora, Sweden

[73] Assignee: The United States of America as represented by the Secretary of Agriculture, Washington, D.C.

[21] Appl. No.: 734,527

[22] Filed: May 16, 1985

[51] Int. Cl.[4] ..... B27L 11/02

[52] U.S. Cl. ..... 144/176; 83/355; 83/680; 241/235; 241/296

[58] Field of Search ..... 241/235, 236, 222, 223, 241/280, 296, 298; 144/176, 188; 83/355, 680, 673

[56] References Cited

U.S. PATENT DOCUMENTS 4,431,039 2/1984 Barwise et al. ..... 241/280 X

FOREIGN PATENT DOCUMENTS 39468 11/1956 Fed. Rep. of Germany ..... 241/236
66708 4/1941 Norway ..... 241/235
216602 10/1967 Sweden ..... 241/235
672026 7/1979 U.S.S.R. ..... 241/235

*Primary Examiner*—Mark Rosenbaum
*Attorney, Agent, or Firm*—M. Howard Silverstein; David G. McConnell

[57] ABSTRACT

A device for disintegration of wood material such as roundwood, tree-tops, branches, waste wood, etc to firewood of a suitable length, said device comprising cutting members for the disintegration. In order to reduce the energy need the invention device comprises two cutting members which rotate in opposite directions and are provided with knives on their insides, one of the two cutting members being arranged to actuate by its knife material fed between the two cutting members in one direction while the other cutting member is arranged to actuate by its knife the material in the opposite direction for cutting off the material between the knives of the two cutting members.

14 Claims, 8 Drawing Figures

COUNTER ROTATING DOUBLE DISC CHUNKER

Figure 1:
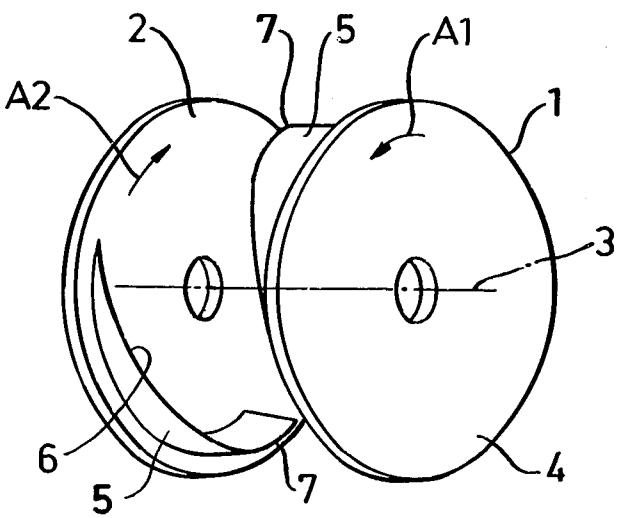

This invention relates to a device for disintegration of wood such as roundwood, tree-tops, branches, waste wood, etc. to firewood of a suitable length.

For production of firewood or pieces of wood-like material cutting by means of a saw followed by cleaving operations, if required and conditioned by the degrees of coarseness and use of the material, was used in the beginning. Disintegration of wood in choppers is also a method which has been known for a long time. By choppers it is achieved by shearing that the material become relatively uniform but consumption of energy and wear, especially at a soiled material, are, on the other hand, embarrassing. The material relatively finely divided in choppers has also been found to have less desired storage, drying and firing properties.

An increased need of wood fuel has brought development or more or less automatized plants for firing also with coarse material, however provided this material still has so-called bulk properties, in which conception the meaning is included that no pieces may have a length and/or width obviously exceeding that of the others.

It is known to disintegrate wood material by the aid of disc choppers and drum choppers of different types and also by means of so-called paddle wheel choppers cutting and crushing the wood like a gear at its passage of a dolly. Another known disintegration device is the so-called bite cutter which cuts and feeds material of only a certain maximum measure by means of a conical screw. Moreover, for disintegration of wood material there is the so-called saw screw which is capable of cutting apart and feeding the material at the same time. In all these cases the material is cut, sawed, chopped or crushed against a dolly of some kind, which will then offer a great frictional resistance which may be so great at choppers that the material often stops for short moments.

Disintegration of wood material to minor pieces to be used as fuel can be carried out, as is well-known, on many alternative places between place of growth and place of combustion. However, it is of a great importance independently of where disintegration takes place to be able to carry out the disintegration in a way as is as energy-saving as possible which is of great importance in the cases when the disintegration is carried out in the field in connection with the place of growth.

The frequent circumstance that fuel raw material needs to be disintegrated at different times for different maintenance systems also has the effect that disintegration principles with low energy requirements become more and more current and of special interest, and therefore the object of this invention is to achieve a device for disintegration of wood material so constituted that it is capable of disintegrating wood material with a minimum need of energy into pieces of such a size as is well-suited for handling, transport, storage and use in energy converters, i.e., combustion plants.

This object is achieved in that the present invention has the characteristic features defined in the claims and in accordance with the principles on which the invention is based, disintegration is carried out by cutting by means of two cutting members, whose force directions and movements are such that the cutting members act against each other and at the same time allow the fed material to move without interruption, i.e., continuously, in the intended feeding direction without being exposed to braking forces from stop means and similar objects.

Figure 2:
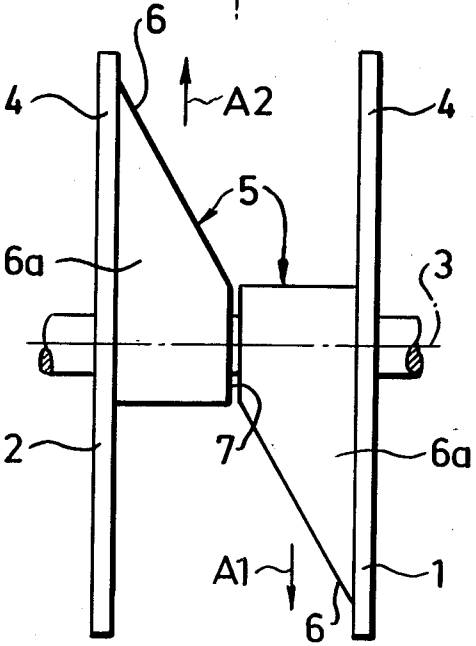
Figure 3:
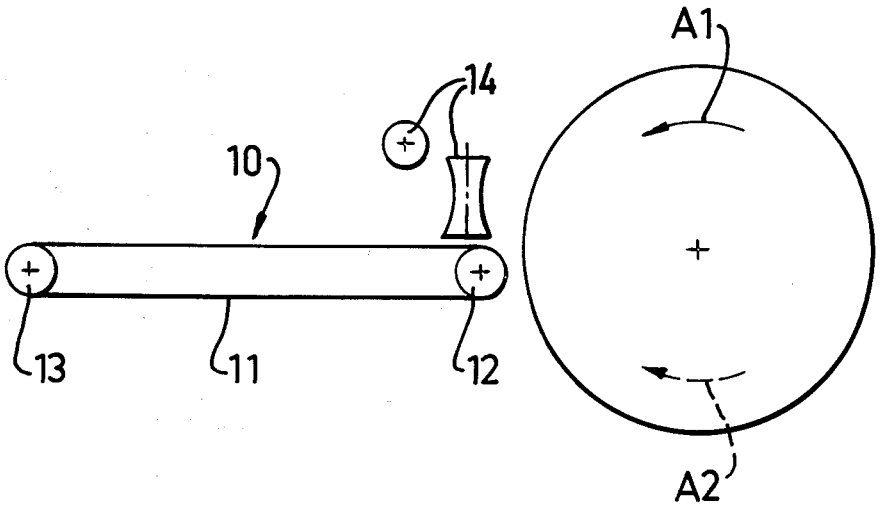
Figure 4:
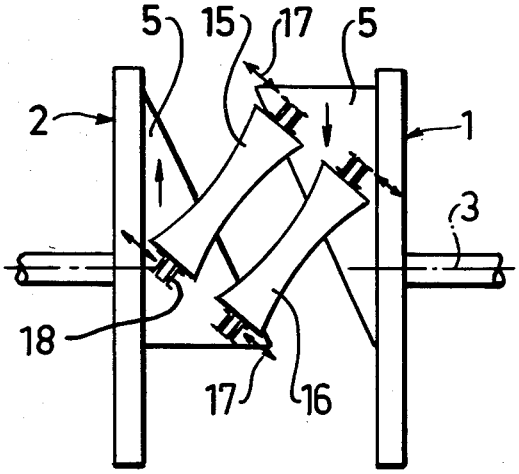
Figure 5:
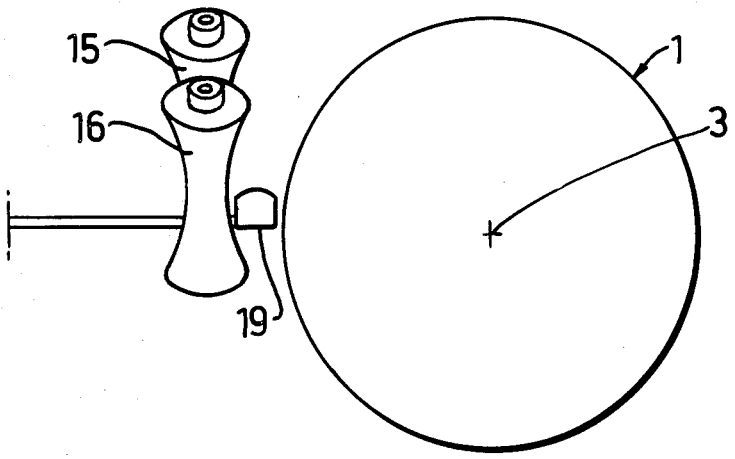
Figure 8:
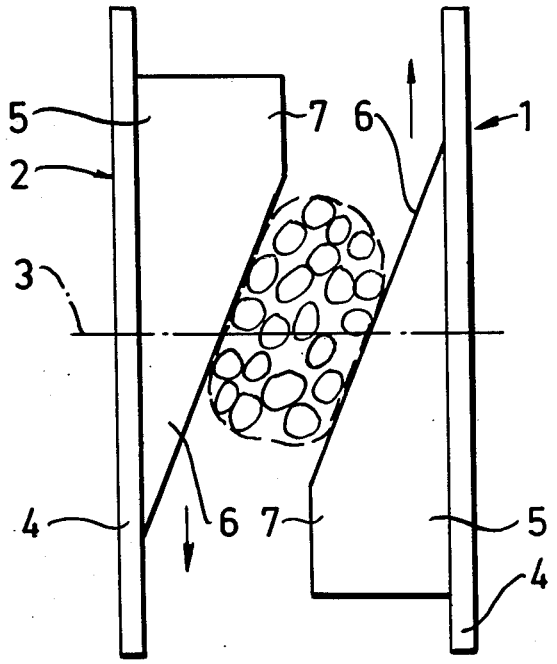
Figure 7:
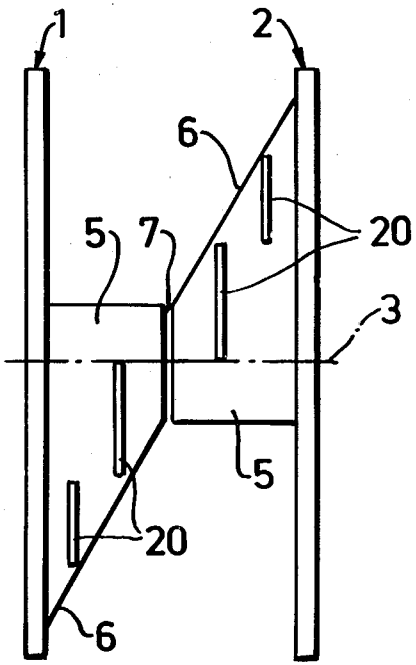
Figure 6:
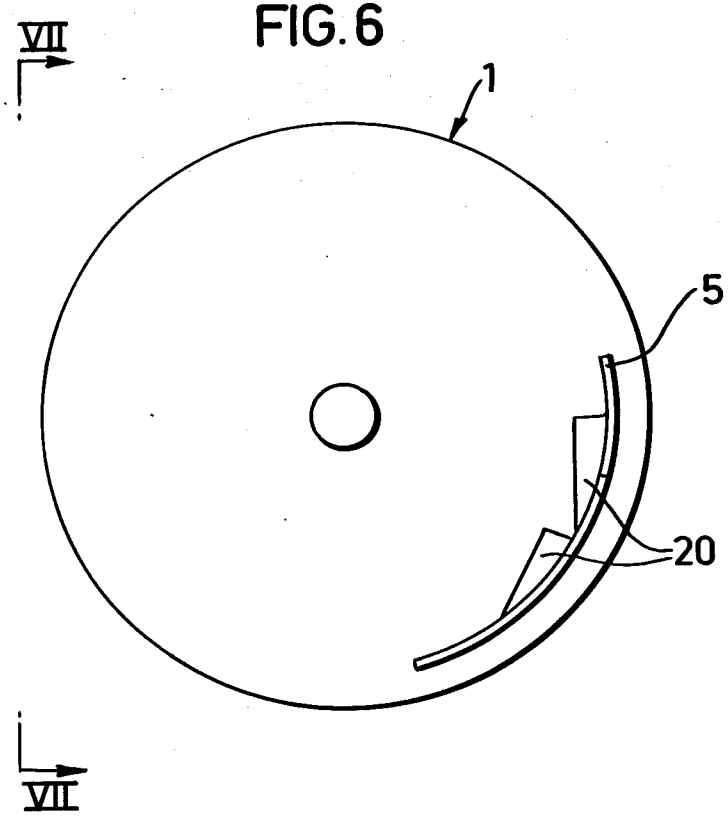

The invention is described in greater detail in the following with reference to the enclosed drawings, in which FIG. 1 is a schematic perspective view of counterrotating cutting members included in the claimed device, FIG. 2 is a view of these cutting members as seen perpendicularly to the axis of rotation of the cutting members and with the cutting members at the end of their cutting phase, FIG. 3 is a schematic lateral view of the cutting members with a feeding arrangement and its position relative to the cutting members, FIG. 4 is a schematic alternative arrangement of feed rollers included in the feeding device, FIG. 5 shows schematically, auxiliary supports arranged in connection with the feed rolls shown in FIG. 4, FIG. 6 is a view substantially taken on the line VI—VI in FIG. 2, FIG. 7 is a schematic view taken substantially on the line VII—VII in FIG. 6, and FIG. 8 is a schematic end view of the cutting members cutting a bundle of wood parts.

In the device for disintegration of wood material according to the present invention two cutting members 1,2 are included which have a common axis of rotation 3 and are arranged to move in opposite directions, as shown by the arrows A1 and A2, respectively. Each cutting member 1,2 consists of a disc 4 which on its inside is provided or formed with a knife 5, with a front, oblique cutting edge 6 and a cutting edge 7 parallel with the disc plane and following in the direction of rotation of each disc respectively. The two cutting members 1 and 2 are made to rotate in the intended directions of means of a drive means not shown in the drawings and a transmission that is embodied in such way that the knives 5 on the disc 4 always meet in the same position during the rotation of the discs, i.e., the cutting members 1 and 2 are always to be driven at exactly the same speed and be so arranged relative to each other that the edge lines of the knives designated by 7 always are straight opposite to one another (see FIG. 2) once during each turn of the cutting members 1,2. In the position shown in FIG. 2 the knives 5 facing each other have their parallel cutting edges 7 oriented quite close to and straight in front of each other for final cutting of material between the knives 5.

Thanks to the form and location of the knives fed material between the knives 5 will be exposed to a cutting force on its opposite sides simultaneously, these cutting forces acting on the opposite sides of the material being completely counter-directed in the embodiment shown in the drawings. Therefore, all material between the knives 5 will be compressed and cut by the knives 5 when these knives pass each other with their parallel cutting edges 7 during the rotation of the cutting members. As a consequence of the counter-directed influence of the knives upon the material material not being exactly centered between the knives 5, the material will also be turned somewhat about its own longitudinal axis, which may particularly occur in the initial stage. In turn this has a positive influence, especially in the cases when the material consists of an amount of big or small logs, branches or the like because the material is packed more closely together thanks to an imparted rotary motion.

The prerequisite of all material being completely cut is that the knife edges 6,7 along at least part of their edge line pass quite close to each other, which is also done by the knives designated 5 with their cutting edges designated 7. Said tendency to turning of the material might possibly have the consequence that part of the material will pass uncut if the knives 5 were given the shape of wedges throughout their length, but to avoid this and to ensure that all material is completely cut each knife 5 is designed with said cutting edge 7 parallel to the plane of the disc 4, said edge 7 passing quite close to the corresponding cutting edge 7 of the opposite knife along a considerably way during each turn of the cutting members 1,2.

The cutting edges 6,7 of the knives can have a symmetrical or asymmetrical shape to control feeding and to obtain the desired cutting effect. Depending on kind of material and material thickness the knives 5 further can be more or less steeply wedge-shaped along their triangular part 6a in order to obtain the greatest possible positive influence on mode of operation and energy need for disintegration of fed material to the desired final product.

Instead of a conventional knife shape knives with a cutting edge similar to saw blades can be used, whereby the energy need can be reduced, especially for disintegration of coarse material, as the frictional losses rise rapidly with increasing material thickness when cutting with knives. Chips created by using a cutting edge similar to a saw blade can be collected with other fuel to be possibly sorted out later, if required.

As shown in the drawings, each knife 5 is so embodied that each point thereon has the same distance to the axis of rotation 3 of the relative disc. When these knives cut through the material in principle this stands idle and does not move, in any case in the feeding direction. By giving the knives such a curved form instead that each point following in the direction of rotation along the engagement line or cutting edge 6 of the knife lies more closely to the axis of rotation of the disc than the preceeding point it is achieved that the material is fed forwards at the same time as it is cut. This type of knife can be made and mounted as one or more segments of a spiral with its centre lying in the centre of rotation of the discs. This type of knives thus tends to pull the material into the disintegration unit formed by the cutting members 1,2. Thus, it is possible to synchronize the feeding movement created by the knives with a feeding device 10 (FIG. 3) arranged outside the disintegration unit so that the material is given the same or almost the same velocity before, during and after the contact with the knives. As the disintegration unit does not include any dolly against which cutting is effected there is no disturbance preventing the knives from providing this feeding movement.

The feeding device 10 shown in FIG. 3 and located in front of the very disintegration unit consists in the example shown of a feed table in the form of a mat or chain conveyor 11 with a driven roll 12 and an undriven such 13. Even if not shown in the drawings this feeding device can be equipped with side walls and holding rolls 14 (FIG. 3), which can be put down from above or from the side, to ensure that even crooked material full of branches is fed towards the disintegration unit 1,2.

If the fed material consists of many separate pieces the influence of the counter-rotating knives 5 may bring the material to spread upwards and downwards parallel to the inclined cutting edges 6 of the knives, as is schematically illustrated in FIG. 8. In order to counteract this spreading tendency the feeding device can be formed in a way as apparent from FIG. 4, i.e., with feed rollers 15 and 16 arranged in front of the cutting members 1 and 2, which rollers are driven and movable towards and from each other, as indicated by the arrows 17 at the bearings designated 18 and only shown schematically. These feed rollers 15 and 16 are slanted relative to the axis of rotation 3 of the discs and by this their position the rollers will contribute to the fed material flow having a favourable form to be disintegrated by the knives 5 of the two cutting members 1 and 2, forces deriving from the knives contributing the keeping the bundle of material together. With a feed table arranged in front of the feed rollers 15, 16 this can have its upper surface lying about on a level with the axis of rotation 3 of the cutting members.

If the feed rollers 15,16 have a very large diameter or, without any such feed rollers, the driven roll 12 of the feed table 11 has a relatively large diameter it may happen that the last short portion of a fed piece will not have enough support but falls down outside the roller before it is caught the next time by the knives 5 of the two cutting members. To avoid this there is arranged an auxiliary support 19 in direct connection in front of the cutting members 1 and 2, as shown in FIG. 5. This auxiliary support 19 can also be arranged between the feed rollers 15,16 and the cutting members 1,2 in close proximity of the knives 5 of these. This auxiliary support 19 has no function of counter-holding means due to the fact that the knife 5 of the cutting member 2 moving upwards at passage of the auxiliary support 19 will get time to lift the piece lying on the auxiliary support 19 before this piece is also actuated by the knife 5 of the other cutting member moving downwards at the passage of the auxiliary support 19.

The different devices for the feeding and orientation of the material before its contact and engagement with the knives 5 of the cutting members all have a considerably simpler function to fulfill than what is the case with for example chipping machines available on the market. In these the feeding devices are subjected to blows and strokes on each chipping occasion, resulting in that these feeding devices must be given too great dimensions to have an acceptable durability and life. Moreover, in the known chipping machines the movement of the material is interrupted each time the chopping knife hits the material, and moreover, braking of the material has the disadvantage that the feeding device is forced to skid on the material or that the feeding device and its drive are exposed to great stresses. In the first case the risk also arises that the skidding does not cease but continues also after the braking of the material caused by the chopping knife, which risk is especially evident on irregular, fresh and wet material. In the second case the great stresses and loads are one of the reasons that the feeding devices of known dissentergration units such as wood chippers will be big, heavy and, moreover, expensive in their entirety. Substantially simpler and cheaper feeding devices can however be connected to the disintegration unit of the present invention to obtain a continuous feeding of material.

In case the knives 5 are worn such a wear can be eliminated by grinding which possibly can be carried out without it being necessary to dismount the knives from their discs 4. Wear as well as grinding of the knives 5 increases the distance between them and therefore the cutting members 1 and 2 are arranged so that distance between them can be adjusted to cause the parallel cutting edges 7 of the knives always to pass close to each other.

The function of the knives of cutting off wood fibers is mentioned, and depending on the thickness of the knives, edge shape, etc. the knives also will be able to split the wood pieces longitudinally, the more effective the shorter pieces are cut off. If relatively long pieces are cut from a material which is relatively coarse the splitting or cleaving ability of the knives 5 can be relatively inconsiderable. Therefore it is suitable to provide the knives 5 with one or more cleaving wedges 20 arranged pependicularly relative to the axis of rotation 3 of the cutting members on the concave side of each knife 5, as shown in FIGS. 6 and 7. In FIG. 6 the cutting member 1 is shown as seen from the knife side and provided with cleaving wedges 20 attached to the inside of the associated knife 5. FIG. 7 shows the two cutting members 1 and 2 with the knives 5 as seen against the concave inside of the knife. As a consequence of the cutting edge 6 of the knives inclined to the plane of the relative disc the bits split loose will be drawing off the centre of the material piece and consequently contribute to an increased cleaving effect.

The material cut and possibly cleft falls down relatively undisturbed between the cutting members 1,2. The material cut by the upwardly moving knife can fall down quite freely while the material cut by the other knife may possibly remain inside this until it is on its way upwards again after rotation of half a turn.

The principles described here are not restricted to horizontal feeding of material to the disintergration unit formed by the cutting members 1 and 2. A vertical or inclined feeding is also possible within the scope of the invention as well as feeding in each point along the upper half of the cutting members 1,2, "the point" of the knives meeting of course being arranged substantially straight in front of the very feed opening. At vertical feeding the two knives will also meet in a straight downwardly directed position which may complicate the feeding of cut material but also provides a possibility of arranging a second cutting place at which possible further disintegration can take place.

The principle of the present invention for cutting of wood material by means of two counter-rotating cutting members is not restricted to the arrangement described above and in the drawings with two discs arranged on a common rotary axis but the cutting members can be arranged each on a separate axis disposed angularly relative to each other as seen from above with a possible variation the whole way up to parallelism. Also in these cases the knives have obtained their shape in order to enable cutting without creating retaining friction. Alternatives with unsymmetrical knife wheels are also possible, especially where particularly long wood pieces are produced and the transport thereof should be problematic. The device can also be equipped with several knives on each wheel or disc. However, the grinding and adjustment must be made in such a way that all knife pairs lie close enough to each other at the end of their cutting phase to obtain the intended cutting effect.

The embodiment of the invention described above with a rotary shaft common to the two cutting members 1,2 can have several feeding places utilized at the same time, for example a feeding opening on each side of the rotary axis 3 of the cutting members. Identically similar feeding devices can be arranged at each such feeding opening, which is especially suitable in the case when the same type of material is fed from both sides. At feeding of different kinds of material from each side respectively of the cutting members 1,2 the details just mentioned in the feeding devices should be formed duly considering the relative material.

If each cutting member 1,2 is provided with two knives 5 two feeding places can still be arranged and placed about 180° from each other according to the invention. With three knives 5 on each cutting member 1,2 it is still possible to have two feeding places but also three and theoretically up to six feeding places are possible, arranged at angular distances of 60°. Even if only two of these feeding places are utilized at the same time, for example one lying close to or in the horizontal plane and the other at an angular distance of 60° or 120° from there the possibility is offered to give the knives such a form and spiral that special effects are obtained. Then it is possible within the scope of the invention to let the terminating part of each pair of knives respectively and provided with the parallel cutting edge 7 have a small radius reduction to the axis of rotation 3 of the cutting members, which results in a braking of the material movement. If the following knife (pair of knives) starts to cut into the material immediately thereafter in a new cutting point located further away the material will not have moved towards the axis centre in a nondesired degree even if the feeding opening was directed from above and downwards and an easily manageable material should move downwards merely by its own weight. The time during which the material is not supported by knife sides is also so short at a moderate number of revolutions that a wood piece will not get time to fall a long way before it is caught by the next pair of meeting knives.

As mentioned above the knives can have a feeding effect. In that case only one point on each knife is oriented straight in front of the other knife as seen in axial direction during the meeting phase of the knives. It can be justified here, especially as far as treatment of delicate material is concerned, to have the end of said knife meeting take place in a section along which each knife respectively is formed with the same radius. It is also possible to have one knife running immediately outside the other as seen radially, whereby it also can cover the other knife to a certain extent. By this arrangement it is achieved that cutting takes place after cleaving and is followed by a short phase during which the knives sliding against each other also cut off very thin and tough fibers.

What is claimed is:

1. A device for cutting wood materials such as roundwood, treetops, branches and waste wood into pieces of such wood materials of predetermined substantially uniform lengths of such materials suitable for combustion comprising a pair of opposed disc members;

means to mount said disc members to that their circular faces are in facing relation to each other;

means to feed the wood materials to be cut into the space between said pair of facing opposed disc members;

means to rotate said disc members in opposite directions;

knife means mounted on each of said disc members on the respective facing circular faces thereof; each of said knife means comprising a first cutting edge and a second cutting edge, said second cutting edge being located in a plane parallel to the plane of rotation of its respective member, said first cutting edge extending in the direction of rotation of its respective disc member from the end of said second cutting edge which leads in the direction of rotation of its respective disc member at a slant to said circular face of said respective disc member, the planes containing the second cutting edges of said knife means on said pair of disc members being located in the space between said facing circular faces of said disc members; and means to locate said disc members with respect to each other such that said second cutting edges pass each other in the same predetermined closely spaced relation during each rotation of said disc members in said opposite directions;

said knife means alone performing all of the cutting of said wood materials; and said oppositely rotating knife means tending to rotate said wood materials about a line of wood material feed defined by said feed means;

whereby wood materials fed longitudinally between said knife means are cut by said knife means into said lengths rather than being chipped or crushed or otherwise finely divided, and whereby cutting of said wood materials proceeds continuously.

2. The device of claim 1, wherein each said knife means including said first and second cutting edges thereof is of arcuate configuration defined by a radius of its respective disc member.

3. The device of claim 2 wherein each knife means is provided, on its side facing its member's axis of rotation, with chopping wedges which are arranged perpendicular to said axis.

4. The device of claim 3, further including at least one feeding device in front of said two disc members for feeding said wood material between said members.

5. The device of claim 3, wherein each knife means one each disc member comprises at least two knives.

6. The device of claim 3, wherein each knife means comprises at least two knives one each disc member, and there are at least as many feeding devices as knives on each disc member.

7. The device of claim 1 wherein said members have a common axis of rotation.

8. The device of claim 1, wherein each said knife means including said first and second cutting edges thereof is of helical configuration having its center coincident with the axis of rotation of its respective disc member.

9. The device of claim 1 wherein each knife means is provided, on its side facing its member's axis of rotation, with chopping wedges arranged pependicularly to said axis.

10. The device of claim 1 further including at least one feeding device in front of said two disc-shaped members for feeding said wood material between said members.

11. The device of claim 10, wherein said disc members have a common axis of rotation and said feeding device comprises two driven feed rollers arranged in parallel which are movable toward and from each other and slanted relative to the axis of rotation of said members.

12. The device of claim 10, wherein each knife means comprises at least two knives on each disc member, and there are at least as many feeding devices as knives on each disc member.

13. The device of claim 10 wherein said feeding device comprises two driven feed rollers arranged in parallel which are movable towards and away from each other and are slanted relative to an axis of rotation of said disc members.

14. The device of claim 1 wherein each knife means comprises at least two knives on each disc member.

* * * * *